US006350102B1

(12) United States Patent
Bailey et al.

(10) Patent No.: US 6,350,102 B1
(45) Date of Patent: Feb. 26, 2002

(54) SHROUD LEAKAGE FLOW DISCOURAGERS

(75) Inventors: Jeremy Clyde Bailey, Middle Grove; Ronald Scott Bunker, Niskayuna, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/575,704

(22) Filed: Jul. 19, 2000

(51) Int. Cl.[7] ..... F01D 5/20; F01D 11/02; F01D 11/08

(52) U.S. Cl. ..... 415/173.5

(58) Field of Search ..... 415/173.1, 173.4, 415/173.5, 173.6, 115, 116, 914; 416/224

(56) References Cited

U.S. PATENT DOCUMENTS

| | | | | | |
|---|---|---|---|---|---|
| 2,410,588 | A | * | 11/1946 | Phelan et al. | 415/173.6 |
| 3,365,172 | A | * | 1/1968 | McDonough et al. | 415/173.4 |
| 3,844,343 | A | * | 10/1974 | Burggraf | 415/116 |
| 4,239,452 | A | * | 12/1980 | Roberts, Jr. | 415/173.5 |
| 4,321,010 | A | * | 3/1982 | Wilkinson et al. | 416/92 |
| 4,466,772 | A | * | 8/1984 | Okapuu et al. | 415/173.5 |
| 4,501,053 | A | * | 2/1985 | Craig et al. | 416/97 R |
| 4,540,335 | A | * | 9/1985 | Yamaguchi et al. | 415/173.1 |
| 4,738,586 | A | * | 4/1988 | Harter | 415/173.5 |
| 4,767,266 | A | * | 8/1988 | Holz et al. | 415/173.5 |
| 5,707,206 | A | * | 1/1998 | Goto et al. | 415/173.1 |
| 6,027,306 | A | | 2/2000 | Bunker | |

FOREIGN PATENT DOCUMENTS

| | | | | |
|---|---|---|---|---|
| SU | 1159970 A | * | 6/1985 | 415/173.6 |

OTHER PUBLICATIONS

"Visualization and Measurements of Rub–Groove Leakage Effects on Straight–Through Labyrinth Seals", International Gas Turbine & Aeroengine Congress & Exhibition, Stockholm, Sweden, Jun. 2–Jun. 5, 1998, pp. 1–8.

* cited by examiner

*Primary Examiner*—Christopher Verdier
(74) *Attorney, Agent, or Firm*—Patrick K. Patnode; Christian G. Cabou

(57) ABSTRACT

A turbine assembly includes a plurality of rotor blades comprising a root portion, an airfoil having a pressure sidewall and a suction sidewall, and a top portion having a cap. An outer shroud is concentrically disposed about said rotor blades, said shroud in combination with said tip portions defining a clearance gap. At least one circumferential shroud leakage discourager is disposed within the shroud. The leakage discourager(s) increase the flow resistance and thus reduce the flow of hot gas flow leakage for a given pressure differential across the clearance gap to improve overall turbine efficiency.

18 Claims, 3 Drawing Sheets

SHROUD LEAKAGE FLOW DISCOURAGERS

FEDERAL RESEARCH STATEMENT

The United States Government may have rights in this invention pursuant to contract number DE-FC21-95MC31176, awarded by the Department of Energy (DOE).

BACKGROUND OF THE INVENTION

This application relates to turbine blades and in particular relates to improved turbine shroud leakage clearance characteristics.

Turbine engines include a compressor for compressing air that is mixed with fuel and ignited in a combustor for generating combustion gases. The combustion gases flow to a turbine such that thermal energy produced within the combustor is converted into mechanical energy within the turbine by impinging the hot combustion gases onto one, or alternatively, a series of bladed rotor assemblies.

The performance and efficiency of turbine engines are critically affected by the clearances that exist between the rotating and stationary components within the turbine. As the clearances increase between the bladed rotor assemblies and the stationary assemblies, such as shrouds, the efficiency of the turbine decreases.

Accordingly, it is desirable for a turbine designer to maintain the clearances, herein referred to as "clearance gaps," between the bladed rotor assemblies and the shroud at a minimum without interfering with the rotation of the rotor assembly or affecting the structural integrity of the rotor or shroud. Even with sophisticated clearance control methods, however, clearance gaps cannot be completely eliminated.

The clearance gaps between the tip of the rotor blades and the adjacent stationary shrouds provide a narrow flow passage between the pressure and suction sides of a blade, resulting in hot gas flow leakage that is detrimental to the blade aerodynamic performance. Although the resulting leakage flow is undesirable, the clearance gaps must accommodate for the overall growth of the blade during operation. The overall growth of the blade is a product of several growth components including thermal expansion of the rotor, which expansion results because the rotor is typically more difficult to cool than the shroud. This cooling difficulty arises because the rotor blade extends over a relatively large radial distance and involves the thermal expansion of many sections, whereas the shroud is a much more compact component.

As beforementioned, the primary detrimental effect of the tip leakage flow is on the blade aerodynamic performance but a second important and less well understood effect concerns the convection heat transfer associated with the leakage flow. Surface area at the blade tip in contact with the hot working gas represents an additional thermal loading on the blade which together with heat transfer to the suction and pressure side surface area must be removed by the blade internal cooling flows. The additional thermal loading imposes a thermodynamic penalty on engine performance and degrades overall turbine performance.

The resultant thermal loading at the blade tip can be very significant and detrimental to the tip durability, especially the blade tip region near the trailing edge, which region can be difficult to cool adequately with blade internal cooling flows. As a result, blade tips have traditionally been one of the turbine areas most susceptible to structural damage.

Structural damage to the blade tips can have a severe effect on turbine performance. Loss of material from the tip increases the clearance gap, increases the leakage flow and heat transfer across the tip, and in general exacerbates all of the above problems.

Numerous conventional blade tip designs exist for maintaining the proper pressure and suction side flow surfaces of the blade at the tip cap as well as providing minimum clearances with the stator shroud. Numerous cooling configurations also exist for cooling the blade tip caps for obtaining useful lives of the blades without undesirable erosion. Since cooling of the blade, including the blade tip, uses a portion of the compressed air from the gas turbine compressor, that air is unavailable for combustion in the combustor of the engine which decreases the overall efficiency of the turbine engine. Accordingly, the cooling of the blade including the blade tip should be accomplished with as little compressed air as possible to minimize the loss in turbine efficiency.

Therefore, it is apparent from the above that there exists a need in the art for improvements in turbine shroud leakage flow characteristics.

SUMMARY OF THE INVENTION

A turbine assembly includes a plurality of rotor blades comprising a root portion, an airfoil having a pressure sidewall and a suction sidewall, and a tip portion having a cap. An outer shroud is concentrically disposed about said rotor blades, said shroud in combination with said tip portions defining a clearance gap. At least one circumferential shroud leakage discourager is disposed within the shroud. The leakage discourager(s) increases the flow resistance and thus reduce the flow of hot gas flow leakage for a given pressure differential across the clearance gap to improve overall turbine efficiency.

DETAILED DESCRIPTION

Figure 1:
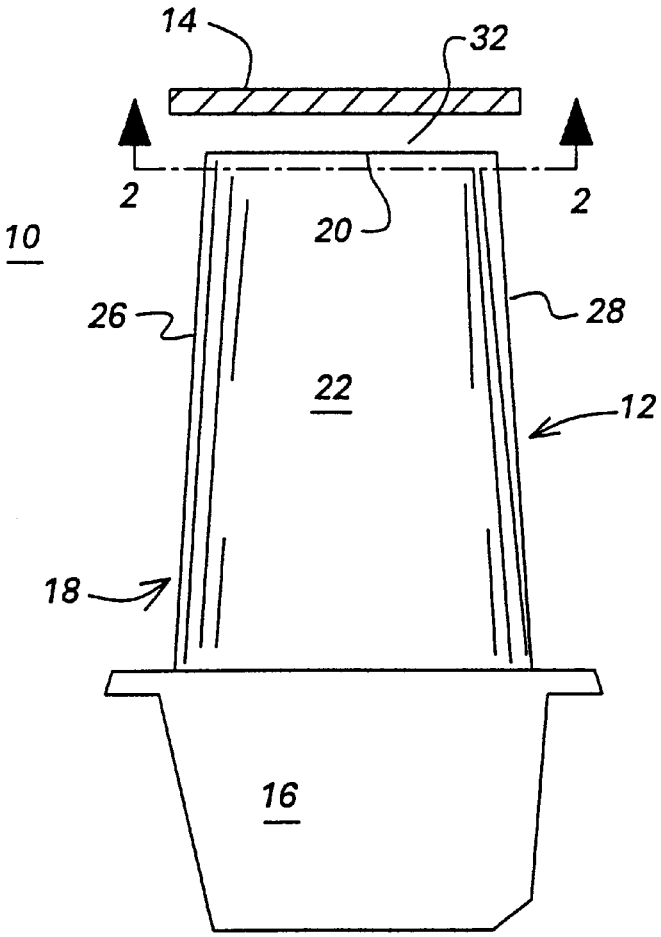
FIG.1 (PRIOR ART)
FIG. 1 is a schematic elevational view of a representative turbine blade.

A turbine assembly 10 comprises a plurality of rotor blade portions 12 and an outer shroud 14 concentrically disposed about rotor blade portion 12, as shown in FIG. 1. Rotor blade portion 12 comprises an inner root portion 16, an airfoil 18 and an outer tip portion 20. Although the present invention is described herein in connection with turbine assembly 10, the present invention is not limited to practice in turbine assembly 10. The present invention can be implemented and utilized in connection with many other configurations. Therefore, it should be understood that turbine assembly 10 is an exemplary assembly in which the present invention can be implemented and utilized.

Airfoil 18 extends outwardly into the working medium flow path of the turbine where working medium gases exert motive forces on the surfaces thereof. Airfoil 18 includes a pressure sidewall 22 and an opposite suction sidewall 24 (FIG. 2) joined together at a leading edge 26 (FIG. 1) and a trailing edge 28. Outer tip portion 20 comprises an outer tip cap 30, as shown in FIG. 2.

As best shown in FIG. 1, outer shroud 14 is spaced apart from tip section 20 so as to define a clearance gap 32 therebetween. As generally discussed in the above background section, the performance and efficiency of the turbine is critically affected by clearance gap 32. The greater the amount of leakage flow through clearance gap 32, the greater the inefficiency of the turbine, as the leakage flow is not exerting motive forces on the blade surfaces and accordingly is not providing work.

Figure 2:
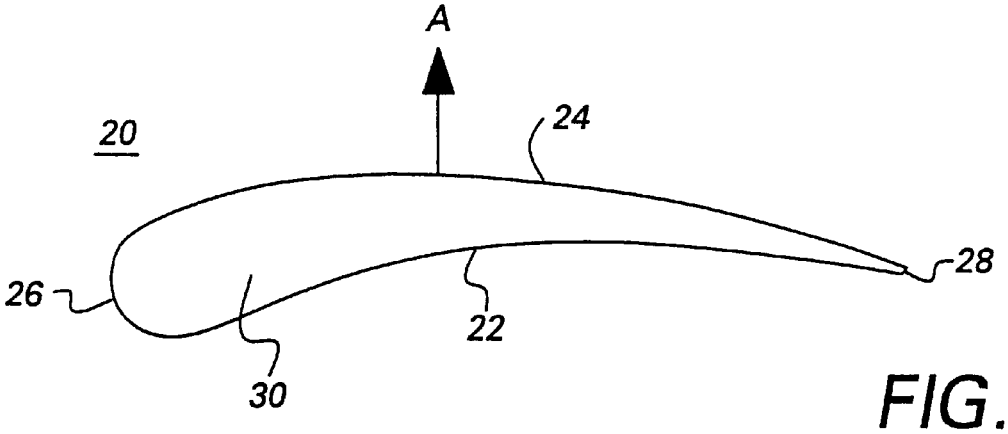
FIG.2 (PRIOR ART)
FIG. 2 is a top planar view of the tip section taken along section 2—2 of FIG. 1.

FIG. 2 shows tip section 20 that is defined by pressure sidewall 22, suction sidewall 24, leading edge 26, trailing edge 28, and tip cap 30. The direction of rotation of blade portion 12 (FIG. 1) is represented generally by arrow "A" of FIG. 2

Figure 3:
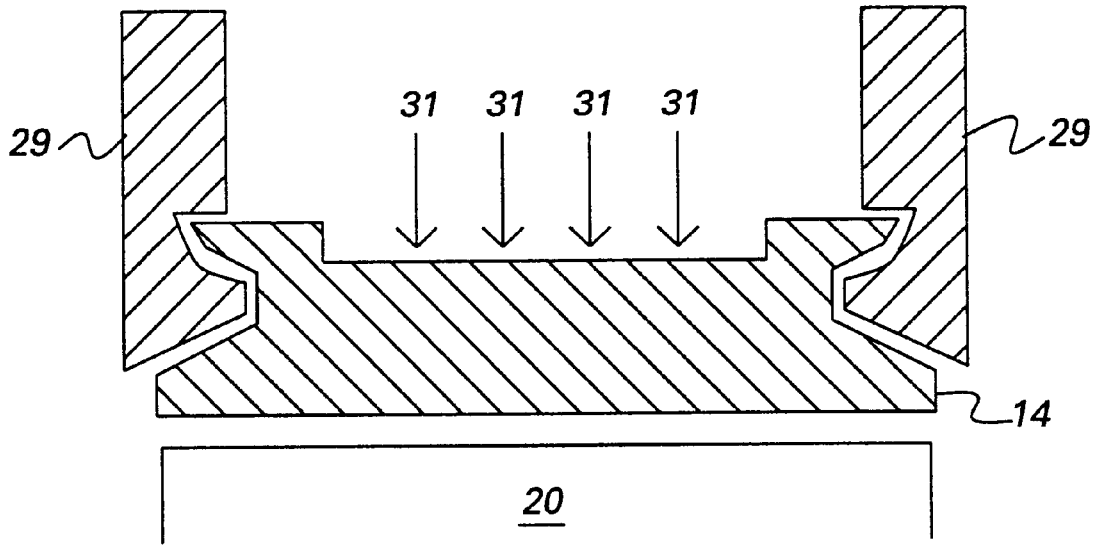
FIG.3 (PRIOR ART)
FIG. 3 is a schematic representation of a conventional shroud and blade configuration.

A conventional shroud 14 and blade tip 20 assembly is shown in FIG. 3. Typically, shroud 14 is structurally supported via casing hangers 29. Cooling air 31 impinges upon a surface of shroud 14 to avoid thermal overloading and eventual failure of shroud 14.

Figure 4:
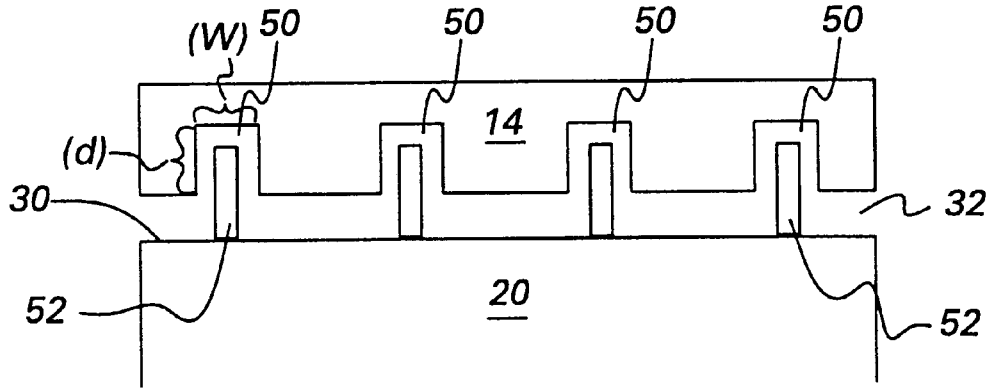
FIG. 4 is a schematic representation of a shroud and blade configuration in accordance with one embodiment of the instant invention.

At least one and typically a plurality of circumferential shroud leakage discouragers 50 are disposed within shroud 14 as shown in FIG. 4. Shroud leakage discouragers 50 are typically circumferential grooves disposed directly into shroud 14 so as to discourage and divert leakage flow between tip section 20 and outer shroud 14 by creating flow resistance therebetween.

Shroud leakage discouragers 50 enhance the flow resistance through clearance gap 32 and thus reduce the flow of hot gas flow leakage for a given pressure differential so as to improve overall turbine efficiency.

The width (w) and depth (d) of shroud leakage discouragers 50 may be varied for best performance, typically depending upon the size of the overall turbine assembly. In one embodiment, the width is in the range between about 0.010 inches to about 0.350 inches. In one embodiment, the depth (d) is in the range between about 0.050 inches to about 0.350 inches. In another embodiment, the width (w) and depth (d) of shroud leakage discouragers 50 are about equal.

In another embodiment, a plurality of the tip cap flow discouragers 52 are disposed on tip cap 30 in alignment with respective shroud leakage discouragers 50. Tip cap flow discouragers are discussed in greater detail in commonly assigned U.S. Pat. No. 6,027,306 (RD-25008), entitled "Turbine Blade Tip Flow Discouragers," which patent is herein incorporated by reference.

Figure 5:
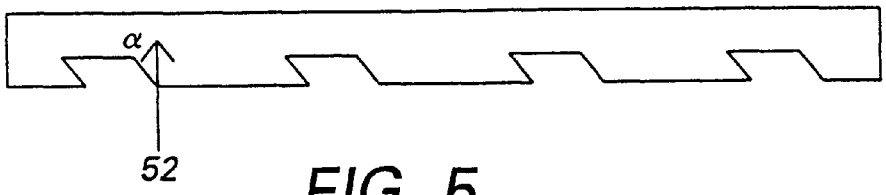
FIGS. 5–8 are schematic representations of a shroud and blade configuration in accordance with other embodiments of the instant invention.
Figure 6:
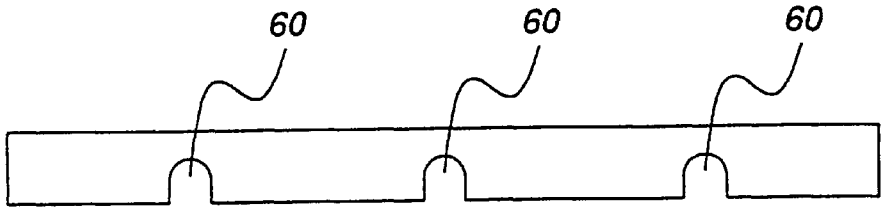
Figure 7:
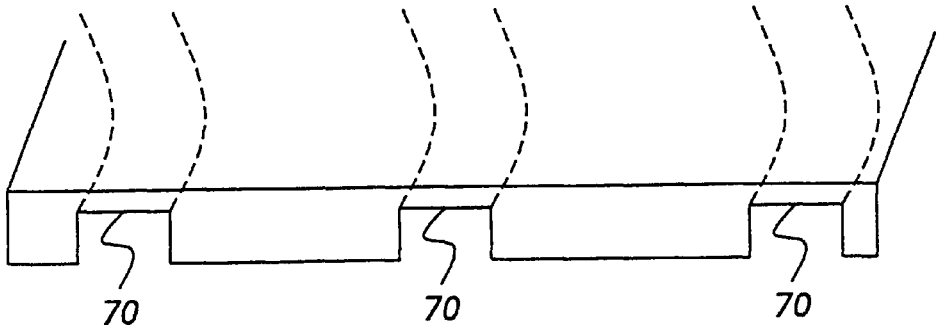

In accordance with another embodiment of the instant invention, FIG. 5 depicts shroud leakage discouragers 50 disposed within shroud 14 at an angle ($\alpha$). The angle ($\alpha$) is in respect to a reference axis 52, which reference axis 52 is aligned generally parallel to the direction of rotation "A" of rotor blade 12. The angle ($\alpha$) is preferably in the range between 0° to about 45°. As depicted in FIG. 5, the leakage discouragers are leaned in the direction toward the blade leading edge 26 (FIG. 1). Such leakage discouragers could also be leaned in the direction toward the blade trailing edge 28. The typical hot gas leakage flow over blade tip 20 is composed of a complex flow distribution which neither proceeds in a direct circumferential direction from blade pressure side 22 to blade suction side 24, nor in a direct axial direction from blade leading edge 26 to blade trailing edge 28. The tip leakage flow at any particular location within tip clearance 32 is a composite of both axial and circumferential flow directions, and may also include specific organized flow features such as vortices. As such, shroud discouragers 50 of various geometric shaping may act as more effective resistance elements to the tip clearance flow. FIG. 6 depicts an alternate discourager geometry 60 which is rounded. In this instance, the discourager does not have sharp features that could contribute to stress concentrations. FIG. 7 depicts yet another discourager geometry 70 in which the feature is arcuate, being curved in a direction 70 so as to impose a greater tip leakage flow resistance by aligning discourager in a nearly perpendicular manner to the local leakage flow direction. It should be noted that any combination of such exemplary discouragers may be used on a shroud, such that differing local leakage flow characteristics are matched to local flow discourager geometries. Each of the embodiments of the instant invention may further comprise rounded edges on respective shroud leakage discouragers as opposed to square edges.

Figure 8:
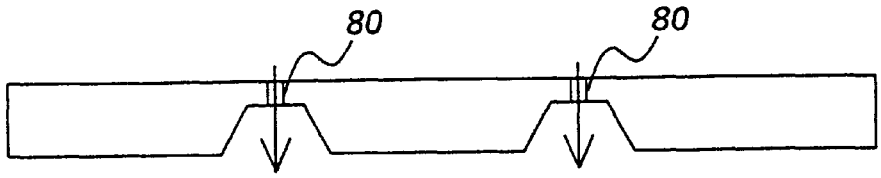

Although the present invention is described herein in connection with shroud leakage discouragers, the present invention is not limited to the use of shroud leakage discouragers as the sole method of leakage flow prevention or tip cooling. In fact, the present invention can be implemented and utilized in many other configurations and combinations. For example, shroud leakage discouragers may be utilized in combination with tip cooling holes of various shapes and orientations. As shown in FIG. 8, an exemplary tip portion having shroud leakage discouragers 50 further comprises a plurality of interspersed tip cooling holes 80. Tip cooling holes 80 can be oriented so as to inject cooling air normal to the tip surface as, for example, may be angled to inject cooling air in some direction relative to the hot gas flow path.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A turbine assembly comprising:

a plurality of rotor blades comprising a root portion, an airfoil having a pressure sidewall and a suction sidewall, and a tip portion having a tip cap;

an outer shroud concentrically disposed about said rotor blades, said shroud in combination with said tip portions defining a clearance gap;

at least one circumferential shroud leakage discourager disposed within said shroud; and a plurality of tip cap flow discouragers disposed on said tip aligned with respective shroud leakage discouragers.

2. A turbine assembly in accordance with claim 1, wherein said at least one circumferential shroud leakage discourager is aligned generally parallel to the direction of rotation of said rotor blades.

3. A turbine assembly in accordance with claim 1, wherein the width (w) of said at least one circumferential shroud leakage discourager is in the range between about 0.010 to about 0.350 inch.

4. A turbine assembly in accordance with claim 1, wherein the depth (d) of said at least one circumferential shroud leakage discourager is in the range between about 0.050 inch to about 0.350 inch.

5. A turbine assembly in accordance with claim 1, wherein the width (w) and the depth (d) of said at least one circumferential shroud leakage discourager is about equal.

6. A turbine assembly in accordance with claim 1, further comprising a plurality of shroud cooling holes.

7. A turbine assembly in accordance with claim 1, wherein said at least one circumferential shroud leakage discourager is square, rounded, or rectangular in shape.

8. A turbine assembly in accordance with claim 1, wherein the pitch (a) of said at least one circumferential shroud leakage discourager varies in the range between about 0° to about 45°.

9. A turbine assembly in accordance with claim 1, wherein said at least one shroud leakage discourager is arcuate in shape.

10. A power generation turbine assembly comprising:

a plurality of rotor blades each having a respective tip portion;

an outer shroud concentrically disposed about said rotor blades;

at least one circumferential shroud leakage discourager disposed within said shroud; and at least one tip cap flow discourager disposed on said tip aligned with respective shroud leakage discouragers.

11. A turbine assembly in accordance with claim 10, wherein said at least one circumferential shroud leakage discourager is aligned generally parallel to the direction of rotation of said rotor blades.

12. A turbine assembly in accordance with claim 10, wherein the width (w) of said at least one circumferential shroud leakage discourager is in the range between about 0.010 to about 0.350 inch.

13. A turbine assembly in accordance with claim 10, wherein the depth (d) of said at least one circumferential shroud leakage discourager is in the range between about 0.050 inch to about 0.350 inch.

14. A turbine assembly in accordance with claim 10, wherein the width (w) and the depth (d) of said at least one circumferential shroud leakage discourager is about equal.

15. A turbine assembly in accordance with claim 10, further comprising a plurality of shroud cooling holes.

16. A turbine assembly in accordance with claim 10, wherein said at least one circumferential shroud leakage discourager is square, rounded, or rectangular in shape.

17. A turbine assembly in accordance with claim 10, wherein the pitch (a) of said at least one circumferential shroud leakage discourager varies in the range between about 0° to about 45°.

18. A turbine assembly in accordance with claim 10, wherein said at least one shroud leakage discourager is arcuate in shape.

* * * * *